US008627640B2

(12) United States Patent
Ansaloni et al.

(10) Patent No.: US 8,627,640 B2
(45) Date of Patent: Jan. 14, 2014

(54) INTERMITTENT ROTATING MACHINE FOR FILLING CAPSULES WITH PHARMACEUTICAL PRODUCTS

(75) Inventors: Angelo Ansaloni, Crespellano (IT); Ernesto Gamberini, Rastignano (IT)

(73) Assignee: MG 2 S.r.l, Pianoro (IT)

( * ) Notice: Subject to any disclaimer, the term of this patent is extended or adjusted under 35 U.S.C. 154(b) by 423 days.

(21) Appl. No.: 12/974,555

(22) Filed: Dec. 21, 2010

(65) Prior Publication Data

US 2011/0146839 A1 Jun. 23, 2011

(30) Foreign Application Priority Data

Dec. 22, 2009 (IT) ..... BO09A0815

(51) Int. Cl.
*B30B 11/00* (2006.01)

(52) U.S. Cl.
USPC ..... 53/560; 53/67; 53/72; 53/454; 276/369; 276/900

(58) Field of Classification Search
USPC ..... 53/454, 468, 471, 52, 53, 67, 72, 560, 53/276, 328, 900, 282, 369
See application file for complete search history.

(56) References Cited

U.S. PATENT DOCUMENTS

| | | | | |
|---|---|---|---|---|
| 1,545,777 | A | 7/1925 | Kath et al. | |
| 4,662,155 | A * | 5/1987 | Chasman | 53/433 |
| 4,731,979 | A * | 3/1988 | Yamamoto et al. | 53/529 |
| 4,828,142 | A | 5/1989 | McKnight | |
| 4,884,602 | A | 12/1989 | Yamamoto et al. | |
| 5,018,335 | A * | 5/1991 | Yamamoto et al. | 53/281 |
| 5,040,353 | A * | 8/1991 | Evans et al. | 53/54 |
| 6,367,228 | B1 | 4/2002 | Wurst et al. | |
| 6,499,279 | B1 * | 12/2002 | Yamamoto et al. | 53/560 |
| 7,093,625 | B2 * | 8/2006 | Smith et al. | 141/67 |
| 7,513,091 | B2 * | 4/2009 | Moodley | 53/429 |
| 7,625,622 | B2 * | 12/2009 | Teckoe et al. | 428/112 |
| 7,785,089 | B2 * | 8/2010 | Teckoe et al. | 425/78 |

FOREIGN PATENT DOCUMENTS

| | | |
|---|---|---|
| EP | 0 135 372 | 3/1985 |
| EP | 194505 | 9/1986 |
| WO | WO 96/36307 | 11/1996 |
| WO | WO 00/32474 | 6/2000 |
| WO | WO 2005/112868 | 12/2005 |
| WO | WO 2006/106012 | 10/2006 |

* cited by examiner

*Primary Examiner* — Christopher Harmon
(74) *Attorney, Agent, or Firm* — Gottlieb, Rackman & Reisman, P.C.

(57) ABSTRACT

In an intermittent rotating machine for filling capsules with pharmaceutical products, each capsule is opened in a respective pocket of a conveying wheel, is filled with a pharmaceutical product, is closed and is finally released from the pocket itself; a supporting block fitted above the conveying wheel defining an upper stopping device for stopping the capsules during the closing thereof, and further defining an upper diverting device for moving the capsules outside the conveying wheel, and supporting a sucking pneumatic device for cleaning the pockets.

15 Claims, 15 Drawing Sheets

INTERMITTENT ROTATING MACHINE FOR FILLING CAPSULES WITH PHARMACEUTICAL PRODUCTS

The present invention relates to an intermittent rotating machine for filling capsules with pharmaceutical products.

BACKGROUND OF THE INVENTION

In the pharmaceutical sector, it is known to make an intermittent rotating machine of the type comprising a conveying wheel, which is mounted to intermittently rotate about a substantially vertical longitudinal axis thereof, and is provided with a plurality of pockets, which are distributed about the mentioned axis, are advanced by the conveying wheel along a predetermined circular path, and are adapted to each receive and keep a respective capsule comprising a bottom and a closing cap of the bottom itself.

The path extends in sequence through an opening station of the capsules, at least one dosing station of a pharmaceutical product into the capsules, a closing station of the capsules, an outlet station of the capsules from the conveying wheel, and a cleaning station of the pockets.

The closing station comprises first raising means for raising the bottoms against the relative caps in a vertical direction substantially parallel to the mentioned axis and upper stopping means for locking the caps in the direction itself; the outlet station comprises second raising means for disengaging the capsules from the relative pockets and upper diverting means for diverting the capsules themselves outside the conveying wheel; and the cleaning station comprises sucking pneumatic means arranged above the pockets and blowing pneumatic means arranged under the pockets themselves.

Because the mentioned upper stopping means, upper diverting means and sucking pneumatic means are mutually separate and independent, the adjustment of the vertical position thereof, necessary for equipping the machine according to the size of the capsules, requires three different regulation operations each time with consequent major working difficulties by operating personnel and relatively long tooling times of the machine.

SUMMARY OF THE INVENTION

It is an object of the present invention to provide an intermittent rotating machine for filling capsules with pharmaceutical products which is free from the above-described drawbacks and which is simple and cost-effective to be implemented.

According to the present invention, there is provided an intermittent rotating machine for filling capsules with pharmaceutical products as disclosed in the attached claims.

BRIEF DESCRIPTION OF THE DRAWINGS

The present invention will now be described with reference to the appended drawings, which illustrate a non-limitative embodiment thereof, in which.

DETAILED DESCRIPTION OF THE INVENTION

Figure 1:
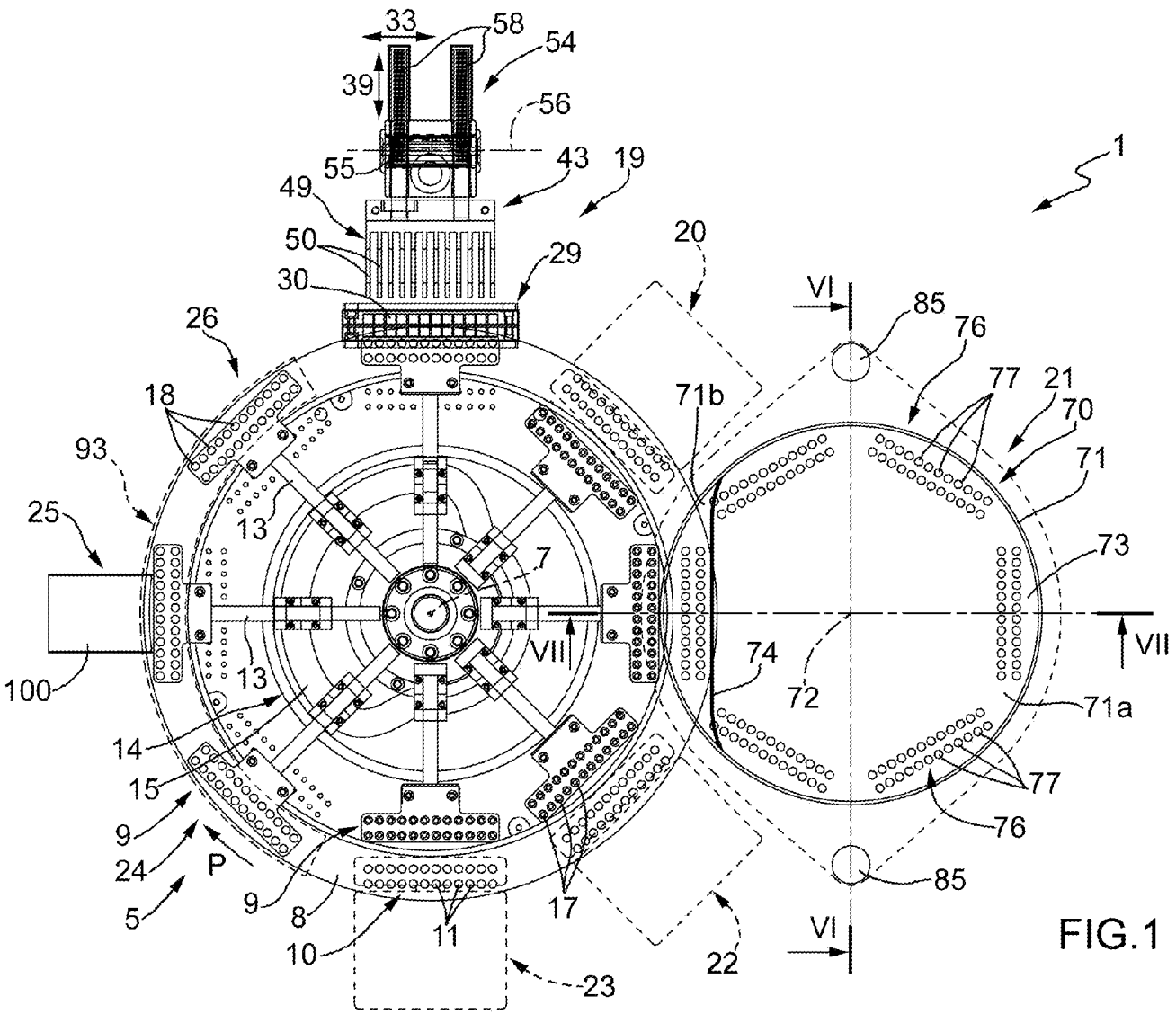
FIG. 1 is a diagrammatic plan view, with parts removed for clarity, of a preferred embodiment of the machine of the present invention.
Figure 2:
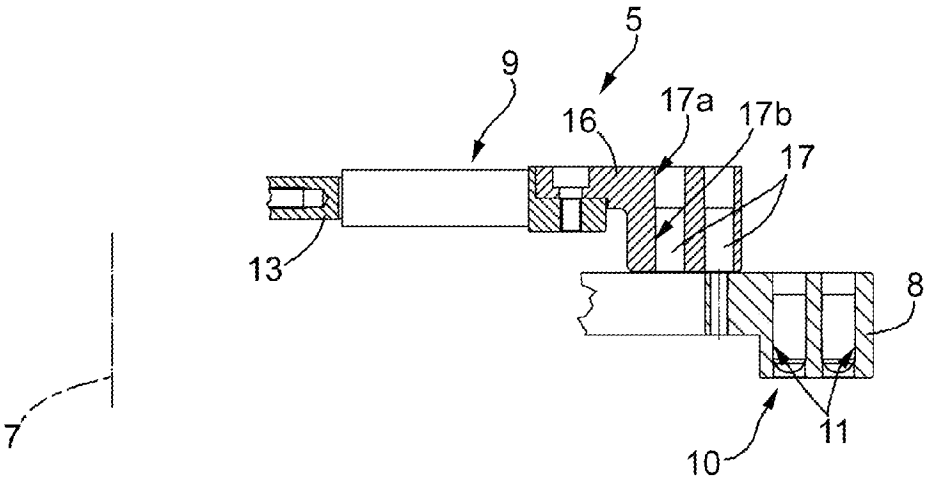
FIG. 2 is a diagrammatic side view, with parts in section and parts removed for clarity, of a first detail of the machine in FIG. 1.
Figure 2:
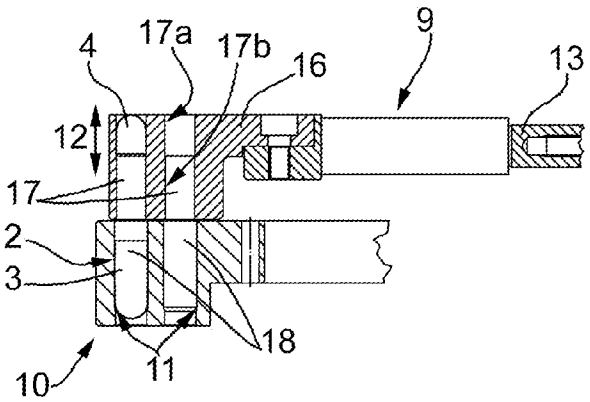

With reference to FIGS. 1 and 2, numeral 1 indicates, as a whole, an intermittent rotating machine for filling capsules 2 with pharmaceutical products, each capsule comprising a respective bottom 3 and a relative closing cap 4 of the bottom 3 itself.

The machine 1 comprises a pocket conveying wheel 5, which is mounted to rotate intermittently, with respect to a fixed frame 6 and under the bias of an actuating device (known and not shown), about a longitudinal axis 7 thereof, substantially vertical and orthogonal to the plane of the sheet in FIG. 1, comprises a lower grip and transfer disk 8 mounted coaxially to the axis 7, and is provided with a plurality of upper grip and transfer units 9 (in the case in point, eight units 9) uniformly distributed about axis 7 itself.

The disk 8 is provided with a plurality of groups 10 of lower seats 11, which are uniformly distributed along the peripheral of the disk 8, are equal in number to the number of units 9, and each comprise a respective plurality of seats 11 (twenty-four seats 11 in the case in point), which extend through the disk 8 in a vertical direction 12 parallel to axis 7, are adapted to each receive and keep a relative bottom 3 arranged with the concavity thereof facing upwards, and are distributed on two reciprocally parallel rows, transversal to axis 7 itself.

Each unit 9 comprises a supporting arm 13, which extends radially outwards, it is mounted over the disk 8, it is advanced by the wheel 5 about the axis 7, and it is slidingly coupled to the disk 8 to perform, with respect to the disk 8 itself, radial movements transversal to direction 12 under the bias of a cam actuating device 14 comprising a cam 15 extending about axis 7 and, for each arm 13, a relative tappet roller (not shown) engaged in the cam 15 itself.

Each arm 13 is provided with a grip and transfer head 16, which is fixed to a free end of the arm 13, it extends transversally with respect to the axis 7, and it is provided with a plurality of upper seats 17, which are equal in number to the number of seats 11 of a group 10 of seats 11, are associated to the seats 11 of a relative group 10 of seats 11, are obtained through the arm 13 in direction 12, are adapted to each receive and keep a relative cap 4 arranged with the concavity thereof facing downwards, and are distributed on two reciprocally parallel rows, transversal to axis 7.

Each seat 17 has a height, measured parallel to direction 12, at least equal to the length of a capsule 2, also measured parallel to direction 12, comprises a wide upper portion 17*a* and a narrow lower portion 17*b*, jointly defines a pocket 18 for a relative capsule 2 with a corresponding seat 11, and is radially moved from the relative arm 13 between an advanced position, in which the seat 17 is substantially aligned with a relative seat 11 in direction 12, and a retracted position, in which the seat 17 is offset with respect to the relative seat 11 in direction 12 itself.

The pockets 18 are advanced by the wheel 5 about the axis 7 (clockwise in FIG. 1) and along a substantially circular path P, which extends about axis 7 starting from a feeding and opening station 19, in which each pocket 18 is adapted to receive and open a relative capsule 2. Along the path P, there are further arranged in order: a first dosing station 20 for feeding a pharmaceutical product in liquid or granular or tablet form into the capsules 2 and to disengage any capsules 2 which remained closed in station 19 from the relative pockets 18, in particular from the relative seats 17; a second dosing station 21 for feeding a pharmaceutical product in powdery form into the capsules 2; a third dosing station 22 for feeding a pharmaceutical product in liquid or granular or tablet form into the capsules 2; a fourth dosing station 23 for feeding a pharmaceutical product in liquid or granular or tablet form into the capsules 2; a closing station 24 for closing the capsules 2; an unloading station 25 for unloading the capsules 2 from the machine 1; and a cleaning station 26 for cleaning the pockets 17.

Obviously, the machine 1 further comprises an electronic control unit (known and not shown) adapted to selectively control the feeding of one or more pharmaceutical products in the capsules 2 at one or more of the stations 20, 21, 22 and 23.

Figure 3A:
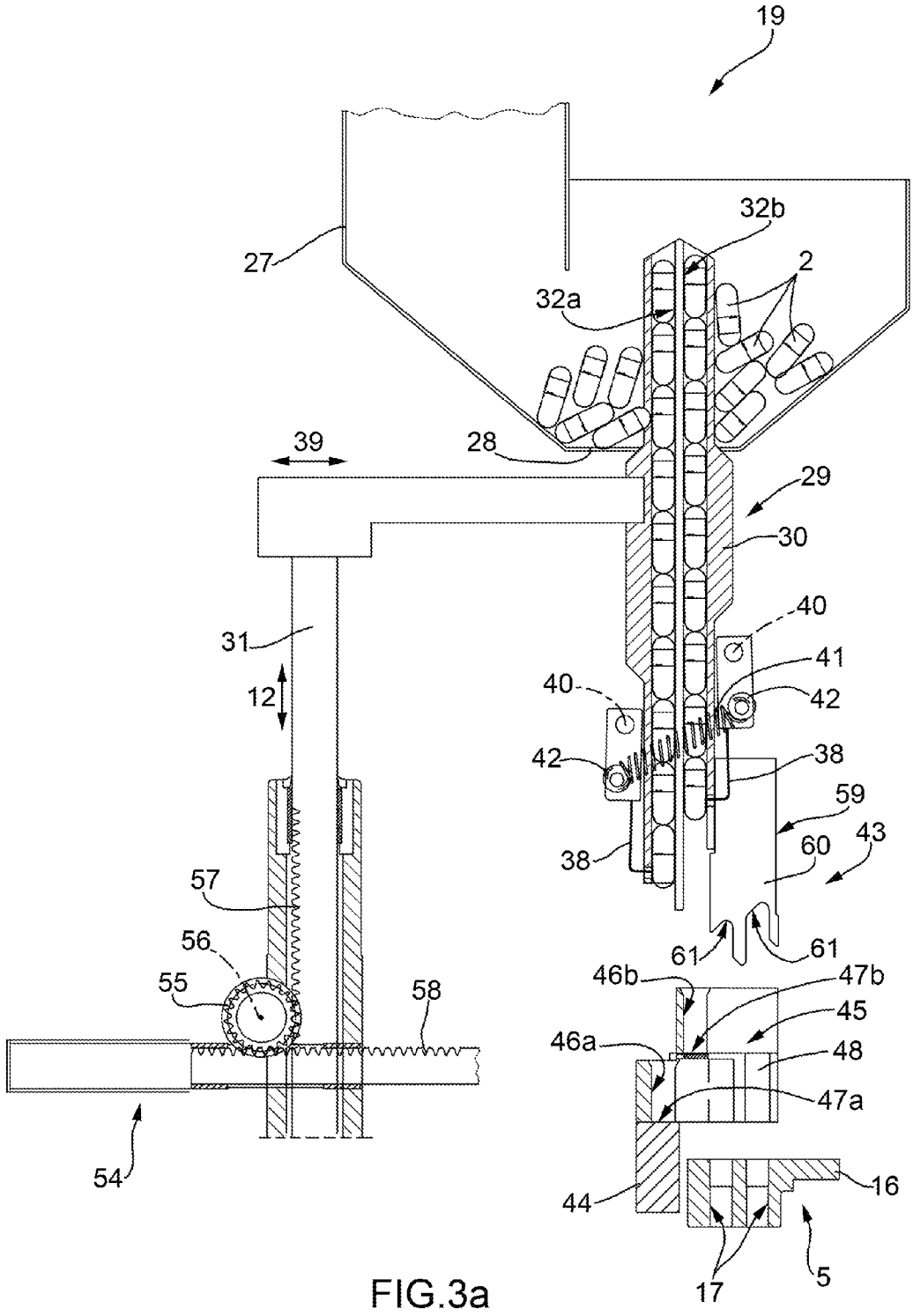
FIGS. 3*a* to 3*f* are five diagrammatic side views, with parts in section and parts removed for clarity, of a second detail of the machine in FIG. 1 shown in five different working positions.
Figure 3B:
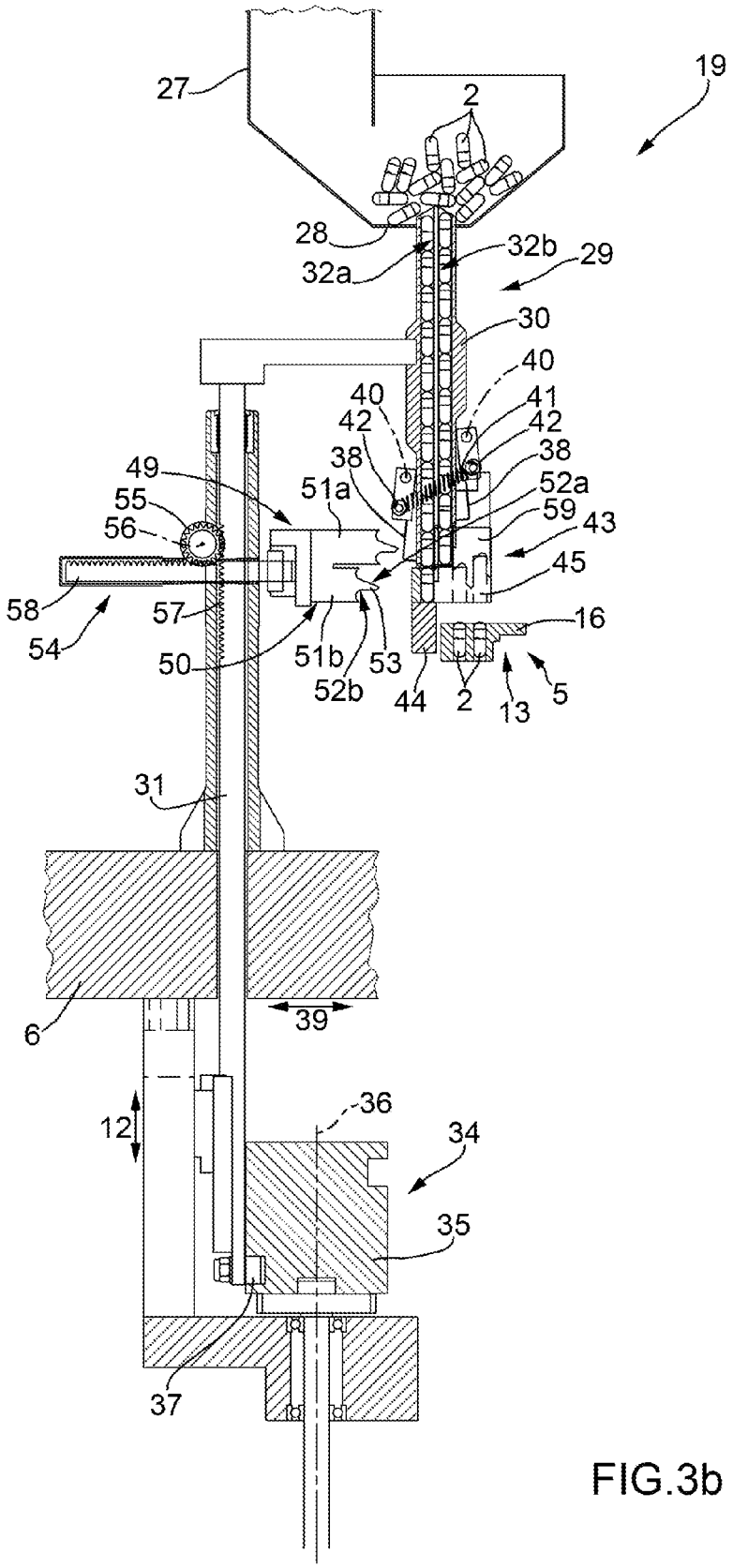
Figure 3C:
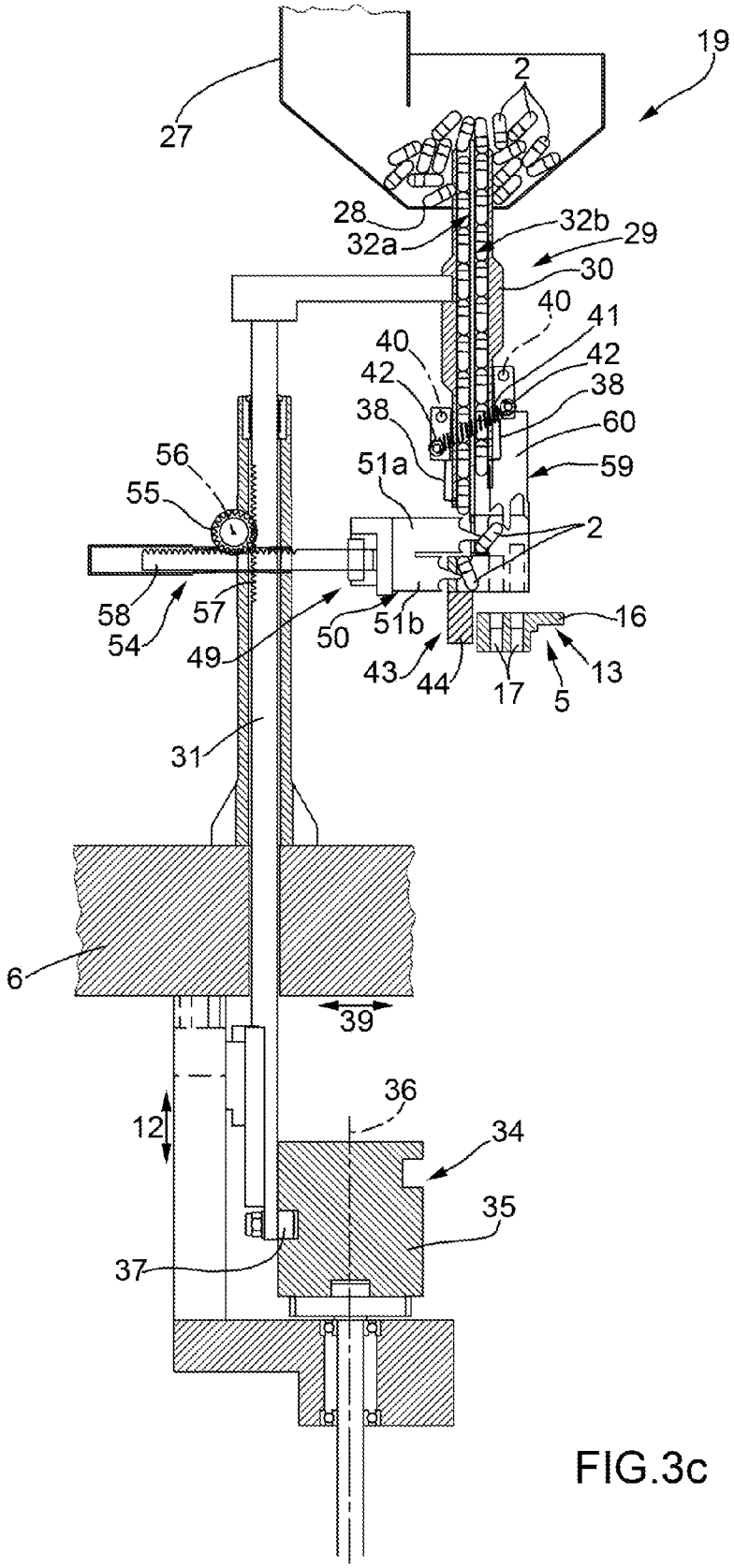
Figure 3D:
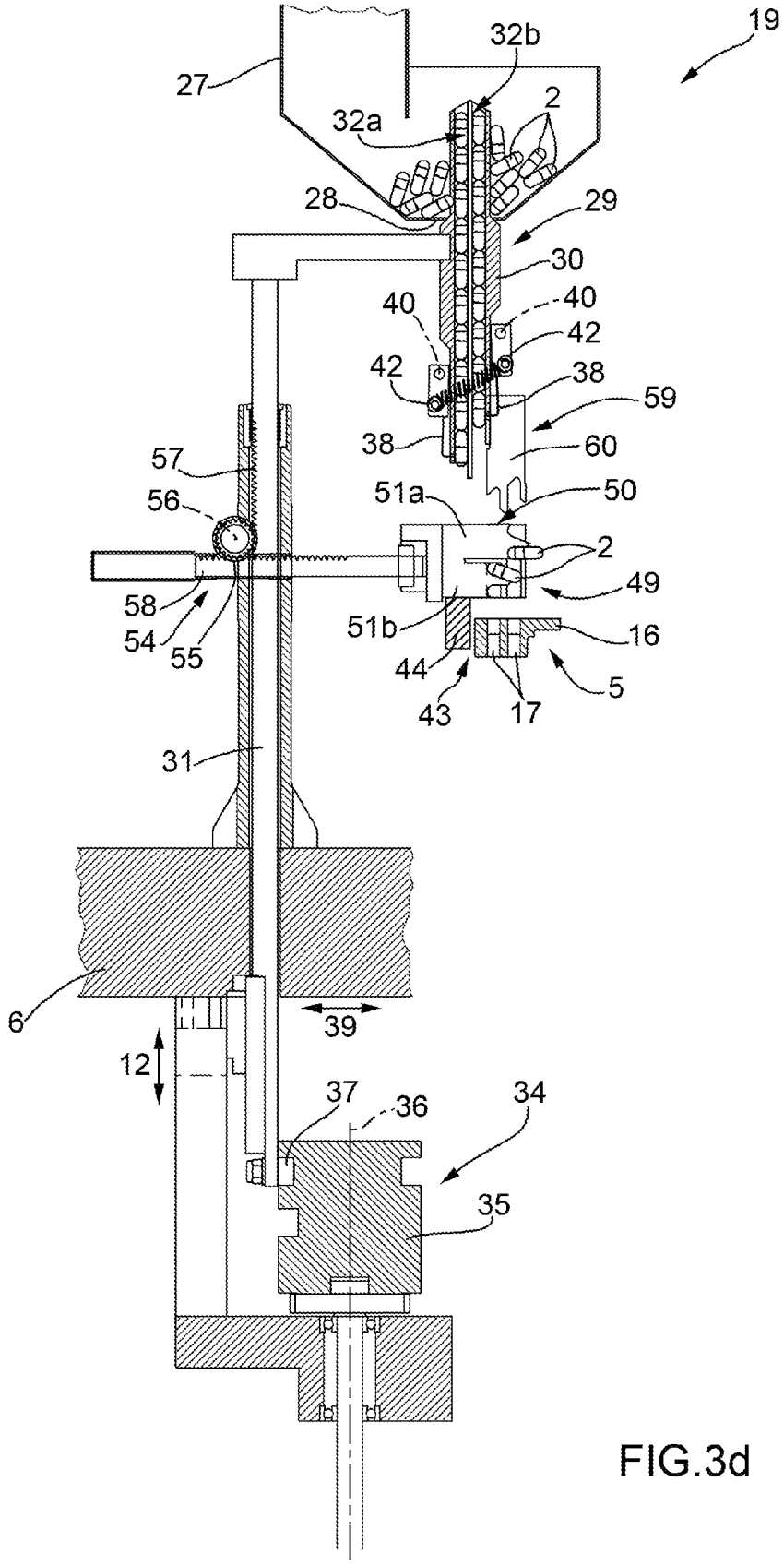
Figure 3E:
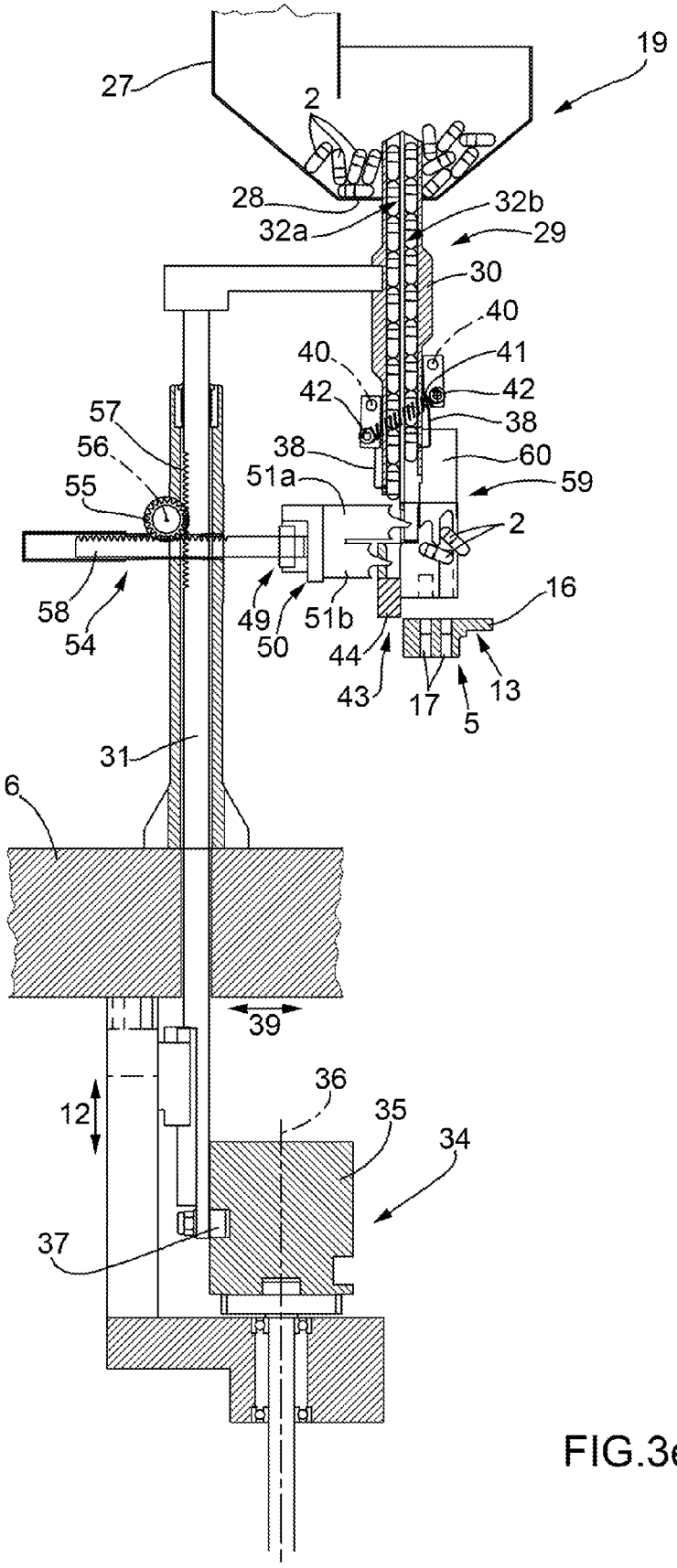
Figure 3F:
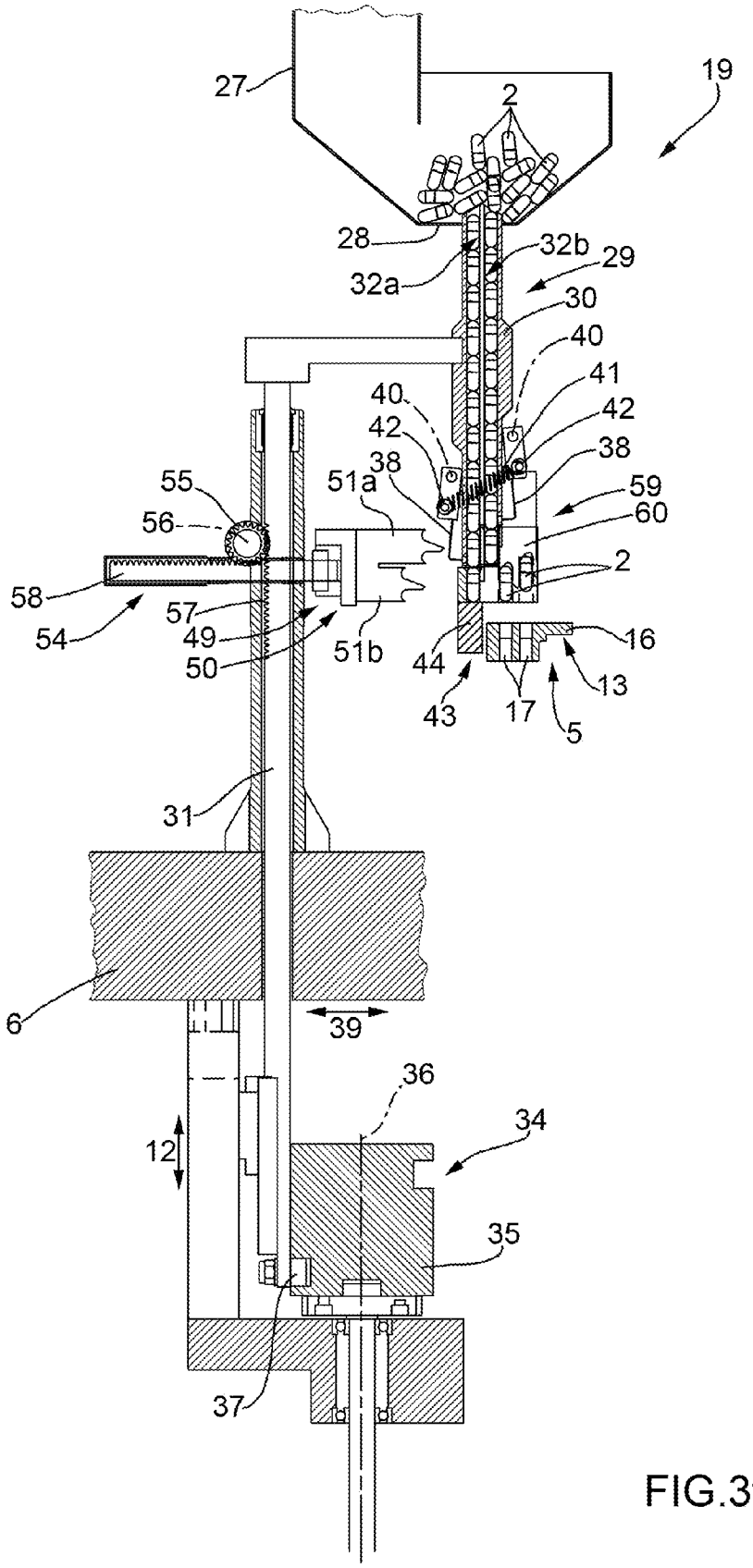
Figure 4:
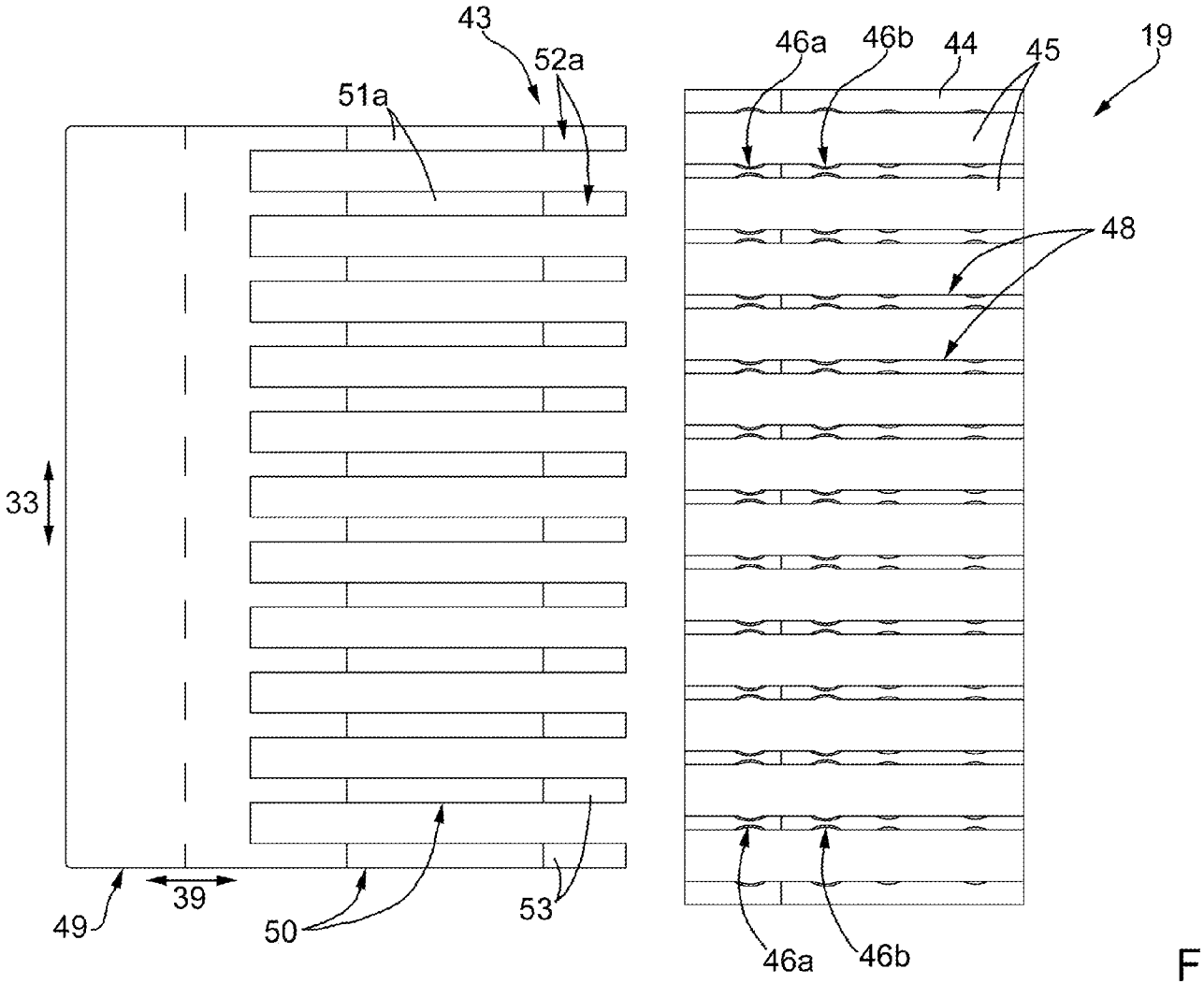
FIG. 4 is a diagrammatic plan view, with parts removed for clarity, of a detail of the figures from 3*a* to 3*f;*

As shown in FIGS. 1, 3, and 4, the station 19 comprises a containment hopper 27 of empty capsules 2 limited at the bottom by a bottom walls 28 substantially horizontal and orthogonal to direction 12, and a feeding device 29 of the capsules 2 from the hopper 27 to the relative pockets 18.

The device 29 comprises a plate 30 of substantially rectangular-shape, which extends on a substantially vertical plane, it is fixed to an upper end of a substantially L-shaped supporting bracket 31, it extends within the hopper 27 through the wall 28, and it comprises a plurality of feeding channels 32 parallel to one another and arranged side-by-side, which are equal in number to the number of seats 17 of a head 16, are obtained through the plate 30 parallel to direction 12, and they are distributed on two rows parallel to one another and to a horizontal direction 33 transversal to direction 12.

With regards to the above, it is worth specifying that the channels 32 (hereinafter indicated by numeral 32*a*) of the row most distant from axis 7 have a length, measured parallel to direction 12, longer than the length of the channels 32 (hereinafter indicated by numeral 32*b*) of the row closest to axis 7, and protrude downwards with respect to the channels 32*b* themselves.

The plate 30 is slidingly coupled to the hopper 27 to perform, with respect to the hopper 27 itself, reciprocating rectilinear movements in direction 12 under the bias of a cam actuating device 34 interconnected and timed with the conveying wheel 5 and comprising a cam 35 mounted to continuously turn about a longitudinal axis 36 thereof parallel to direction 12 and a tappet roller 37 mounted to rotate about a lower end of the bracket 31 and engaged in the cam 35 itself.

As a result of the movements of the plate 30 in direction 12, the capsules 2 randomly fall in sequence into the relative channels 32*a*, 32*b*, i.e. with the relative caps 4 arranged over the relative bottoms 3 or with the relative bottoms 3 arranged over the relative caps 4, and they are locked along the relative channels 32*a*, 32*b* by means of two comb-like locking elements 38, which are arranged on opposite sides of the plate 30 in a horizontal direction 39 orthogonal to directions 12 and 33, are offset with respect to one another in direction 12, are hinged to plate 30 to oscillate with respect to the plate 30 itself, about respective horizontal axes 40 of fulcrum parallel to one another and to direction 33 between a locking position, in which the elements 38 extend within the relative channels 32*a*, 32*b* to lock the relative capsules 2 in direction 12, and a releasing position, in which the elements 38 are arranged outside the relative channels 32*a*, 32*b* to allow the descent of the capsules 2 themselves.

Each element 38 is moved and normally kept in its locking position by a spring 41 interposed between the elements 38, is provided by an opening roller 42 mounted to rotate about a rotation axis parallel to axes 40, and it is moved from its locking position to its releasing position during the descent of the plate 30 by the engagement of the roller 42 with a releasing element (not shown) mounted along the path of the roller 42 itself.

The station 19 further comprises an orienting device 43 comprising, in turn, a supporting block 44 provided with a plurality of orientation channels 45, which are equal in number to the number of channels 32*a*, 32*b* of a row of channels 32*a*, 32*b*, are aligned to one another in direction 33, extend in direction 39, are longitudinally open in direction 39, and are each associated to a respective pair of channels 32*a*, 32*b* aligned to one another in direction 39 itself.

Each channel 45 comprises two vertical inlet portions 46*a*, 46*b*, which extend in direction 12, are aligned to the relative channels 32*a* and 32*b*, respectively, in direction 12, have a substantially cylindrical shape, are limited at the bottom by respective bottom walls 47*a*, 47*b* orthogonal to direction 12, and have a width measured parallel to direction 33, approximating by excess the diameter of a cap 4; and a horizontal outlet portion 48, which extends in direction 39, is vertically open in direction 12, and is laterally limited by two flat walls arranged at a distance from one another measured parallel to direction 33, approximating by defect the diameter of a cap 4.

The walls 47*a* are coplanar to one another and to a containment plane parallel to and arranged underneath the containment plane of the walls 47*b*.

The device 43 further comprises a first comb-like orienting element 49, which extends in direction 33, and comprises, in turn, a plurality of substantially flat orienting teeth 50 parallel to one another, which extend in direction 39 and on respective vertical planes parallel to one another and orthogonal to direction 33, are equal in number to the number of channels 45, and have a thickness measured parallel to direction 33, approximating by defect the width of the outlet portion 48 of a channel 45, also measured parallel to direction 33.

Each tooth 50 comprises two reciprocally parallel orienting elements 51*a*, 51*b*, of which element 51*a* is arranged above element 51*b*, protrudes from the element 51*b* towards the wheel 5 in direction 39, and is associated to portion 46*b* of the relative channel 45, and element 51*b* is associated to portion 46*a* of the relative channel 45 itself. Each element 51*a*, 51*b* has a substantially rectangular shape, and is relieved at both the top and the bottom at a free end thereof to define two cavities 52*a*, 52*b* separated from one another by an elongated appendix 53, of which cavity 52*a* extends above cavity 52*b* and is arranged with the concavity thereof facing upwards, and cavity 52*b* is arranged with the concavity thereof facing downwards.

The orienting element 49 is mobile in direction 39 between an advanced position, in which the teeth 50 engage the relative channels 45, and a retracted releasing position of the channels 45 itself, and is interconnected and offset with the plate 30 by means of an actuating device 54 comprising a sprocket 55, which is mounted to rotate with respect to the frame 6, about a longitudinal axis 56 thereof parallel to direction 33, is coupled to a rack 57 obtained on the bracket 31 parallel to direction 12, is further coupled to two racks 58 protruding from the element 49 on opposite side of the wheel 5 in direction 39, and is rotated about the axis 56 by the movement of the bracket 31 in direction 12 itself.

The device 43 further comprises a second comb-like orienting element 59, which extends in direction 33, is fixed to the plate 30, protrudes downwards from the plate 30, and it comprises, in turn, a plurality of substantially flat orienting teeth 60 (only one of which is shown in FIG. 3), parallel to one another, which extend in direction 12 and on respective vertical planes parallel to one another and orthogonal to direction 33, are aligned to one another in direction 33, they are equal in number to the number of channels 45, and they have a thickness measured parallelly to direction 33, approximating by defect the width of the outlet portion 48 of a channel 45 also measured parallel to direction 33.

Each tooth 60 is substantially rectangular-shaped and has two lower cavities 61, which have respective concavities facing downwards, are parallel and arranged side-by-side, are open at the bottom in direction 12, are offset with respect to one another in direction 12, and are aligned in direction 12 itself with relative pockets 18 arranged in station 19.

The operation of the feeding and opening station 19 will now be described with reference to figures from 3*a* to 3*f*, taking into account a single channel 45 and the relative pairs of channels 32*a*, 32*b*, and starting from an instant in which (FIG. 3*a*):

the plate 30 and the orienting element 59 are arranged in a raised position, in which the element 59 extends outside the block 44 and, thus, outside the channels 45 and in which the two locking elements 38 are arranged in their locking positions;

the orienting element 49 is arranged in its advanced position; and channel 45 taken into consideration is empty.

After the descent of the plate 30 and of the element 59 in direction 12, and the rotation of the sprocket 55 about the axis 56, the element 49 is moved by means of the racks 58 in direction 39 from the advanced position thereof to the retracted releasing position thereof of the block 44 and, thus, of the channels 45; and the locking elements 38 are moved above the relative fulcrum axes 40 to the releasing positions thereof to allow a capsule 2 of each considered channel 32*a*, 32*b* to descend into the relative inlet position 46*a*, 46*b* of the considered channel 45 and to be arranged in contact with the relative bottom wall 47*a*, 47*b* (FIG. 3*b*).

At this point, the plate 30 and element 59 are raised again in direction 12; the element 49 is moved in direction 39 from the retracted position thereof to the advanced position thereof to allow each appendix 53 to come into contact with an intermediate point of the relative capsule 2, to rotate the capsule 2, and to orient the capsule 2 itself with the relative bottom 3 arranged under the relative cap 4 in direction 39; and each capsule 2 is advanced in direction 39 within the relative cavity 52*a*, 52*b* (FIGS. 3*c* and 3*d*).

Because the outlet portion 48 of the channel 45 is narrower than the width of the inlet portions 46*a*, 46*b*, the cap 4 of each capsule 2 advanced by the relative appendix 53 in direction 39 is initially blocked at the inlet of the portion 48 by the friction exerted on the cap 4 by the side walls defining the portion 48 itself. Consequently, regardless of the orientation thereof in the relative portion 46*a*, 46*b*, each capsule 2 rotates under the bias of the relative appendix 53, again so as to advance within the portion 48 with the relative bottom 3 arranged in front of the relative cap 4.

The capsules 2 are kept by friction within the portion 48 allowing:

the plate 30 and the element 59 to move down again in direction 12;

the element 49 to move to the retracted disengagement position of the capsules 2 and of the block 44;

the elements 38 to open to advance two new capsules 2 into the relative portions 46*a*, 46*b;* the cavities 61 of the element 59 to engage, rotate and orient the capsules 2 with the relative bottoms 3 underneath the relative caps 4; and the element 59 to lower the capsules 2 in direction 12 within the relative pockets 18 arranged in station 19 (FIGS. 3*e* and 3*f*).

Once inside the relative pocket 18, each capsule 2 is opened by a sucking pneumatic device (not shown) connected to the relative lower seat 11, the relative cap 4 is kept by the widened portion 17*a* of the relative upper seat 17, the relative bottom 3 is advanced within the relative lower seat 11, and the capsule 2 itself is advanced by the conveying wheel 5 about the axis 7 and through the stations 20, 21, 22, and 23.

The stations 20, 22, and 23 are provided with relative feeding station (known and not shown) adapted to feed in the capsules 2 pharmaceutical products in liquid or in granule or in tablet form, and the station 20 is further provided with an expelling device 62 for disengaging the capsules 2 closed in station 19 from the relative seats 17.

Figure 5:
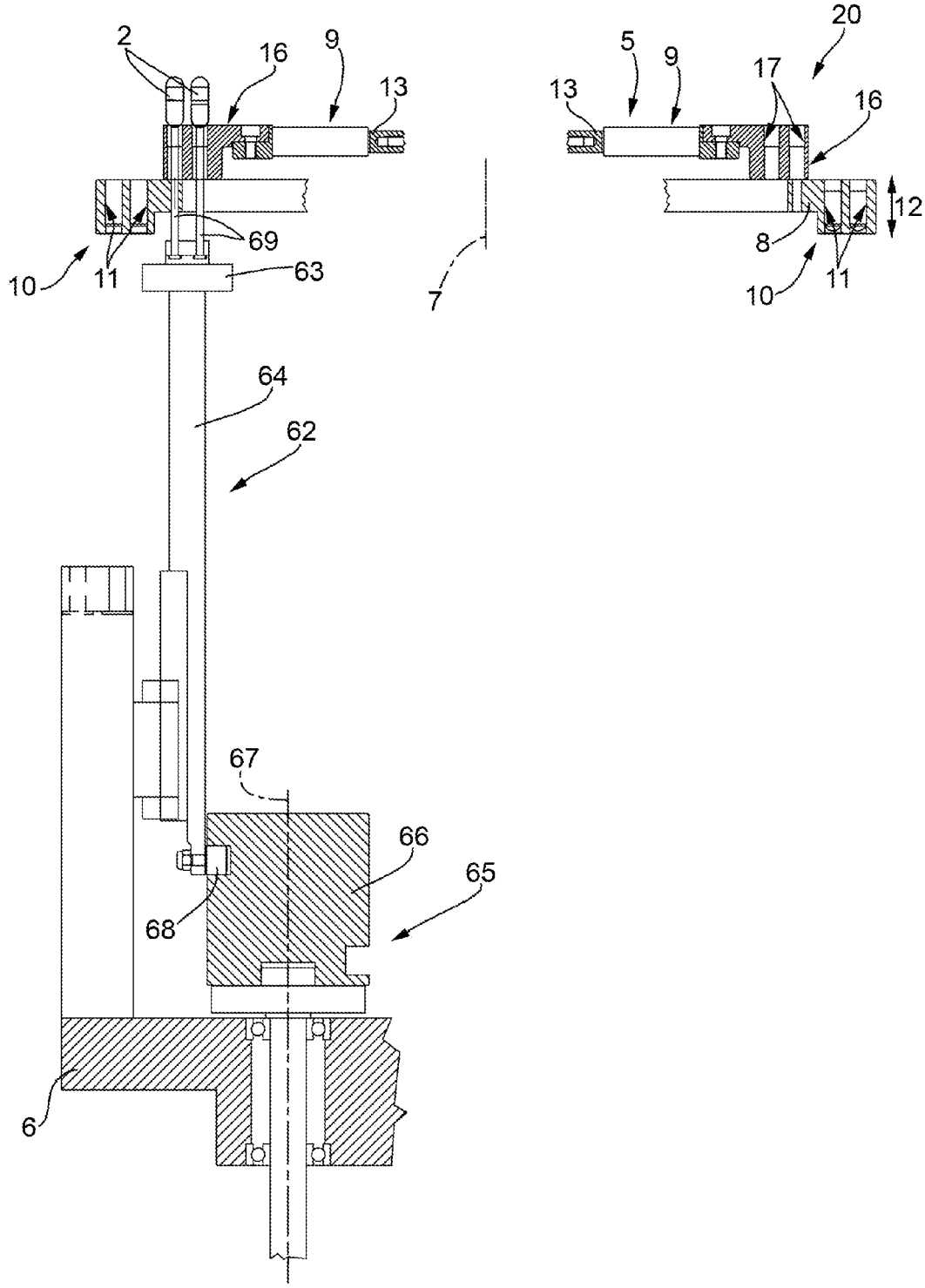
FIG. 5 is a diagrammatic side view, with parts in section and parts removed for clarity, of a third detail of the machine in FIG. 1.

With reference to FIG. 5, the device 62 comprises a substantially horizontal supporting plate 63, which is orthogonal to direction 12, it extends under the disk 8, and is fixed to a free end of a supporting bar 64, which extends in direction 12, and it is slidingly coupled to the frame 6 to perform with respect to the frame 6 itself, rectilinear movement in direction 12 under the bias of a cam actuating device 65 interconnected and timed with the conveying wheel 5 and comprising a cylindrical cam 66 mounted to continuously rotate about a longitudinal axis 67 thereof parallel to direction 12 and a tappet roller 68 mounted to rotate about a lower end of the bar 64 and engaged in the cam 66 itself.

The plate 63 supports a plurality of elongated pushing elements 69, which extend upwards from the plate 63 in direction 12, are equal in number to the number of seats 17 of a grip and transfer head 16, and are moved by the device 65 in direction 12 between a raised working position, in which the elements 69 extends within the relative seats 17 to disengage any closed capsules 2 which may be present from the seats 17, and a lowered resting position, in which the elements 69 are arranged underneath the disk 8.

Figure 6:
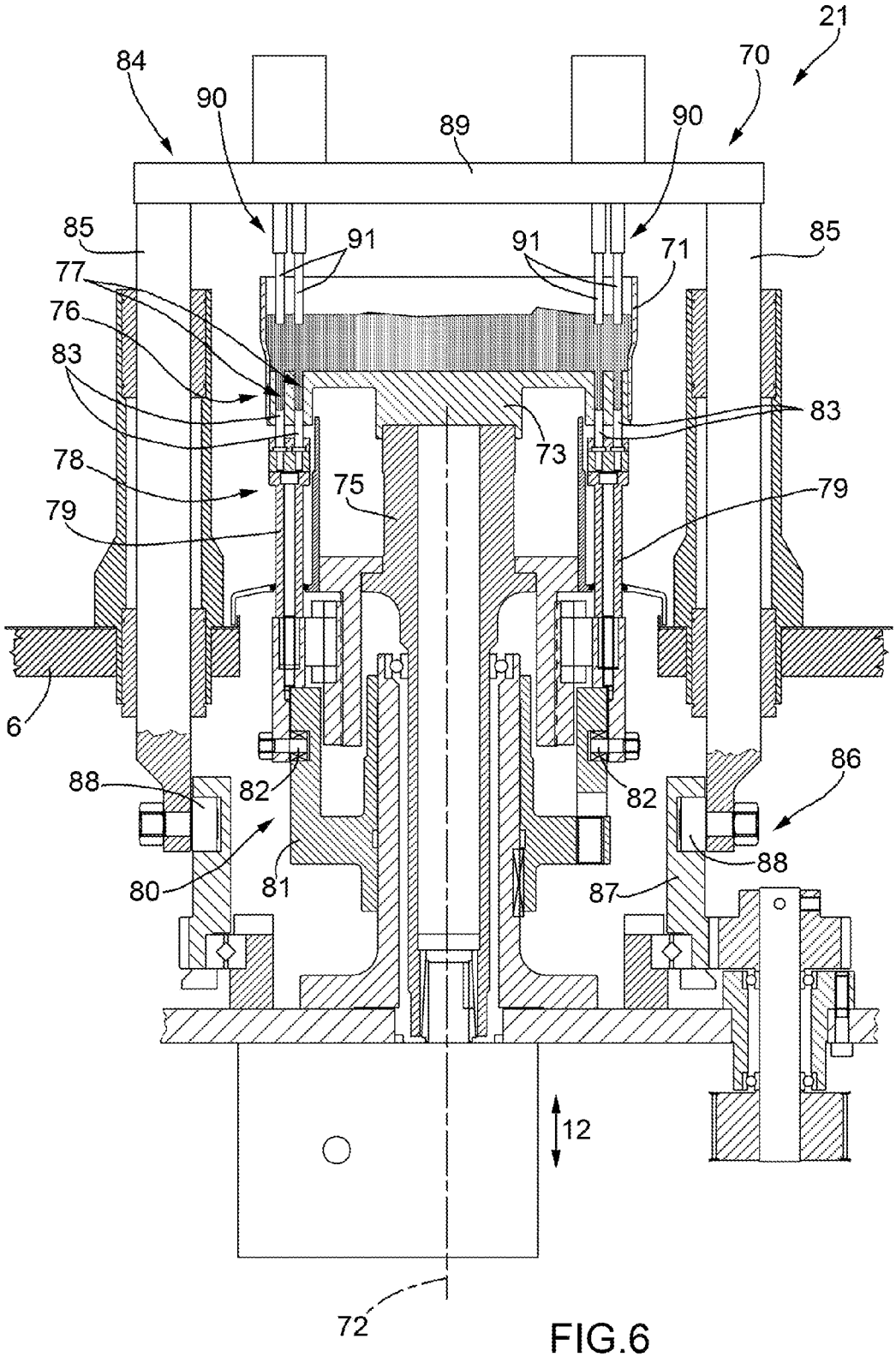
FIG. 6 is a section taken along line VI-VI in FIG. 1.
Figure 7:
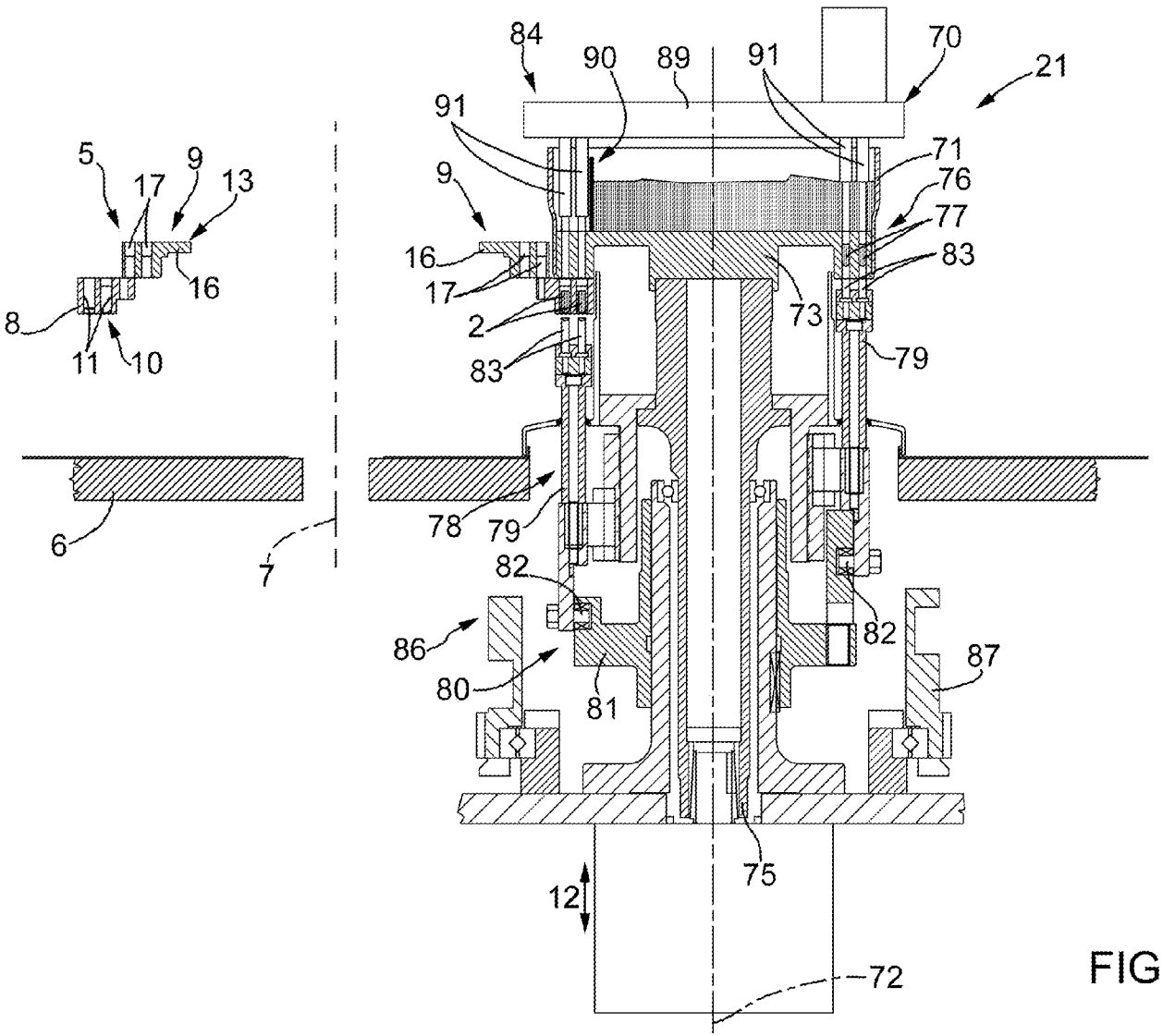
FIG. 7 is a section taken along line VII-VII in FIG. 1.
Figure 8:
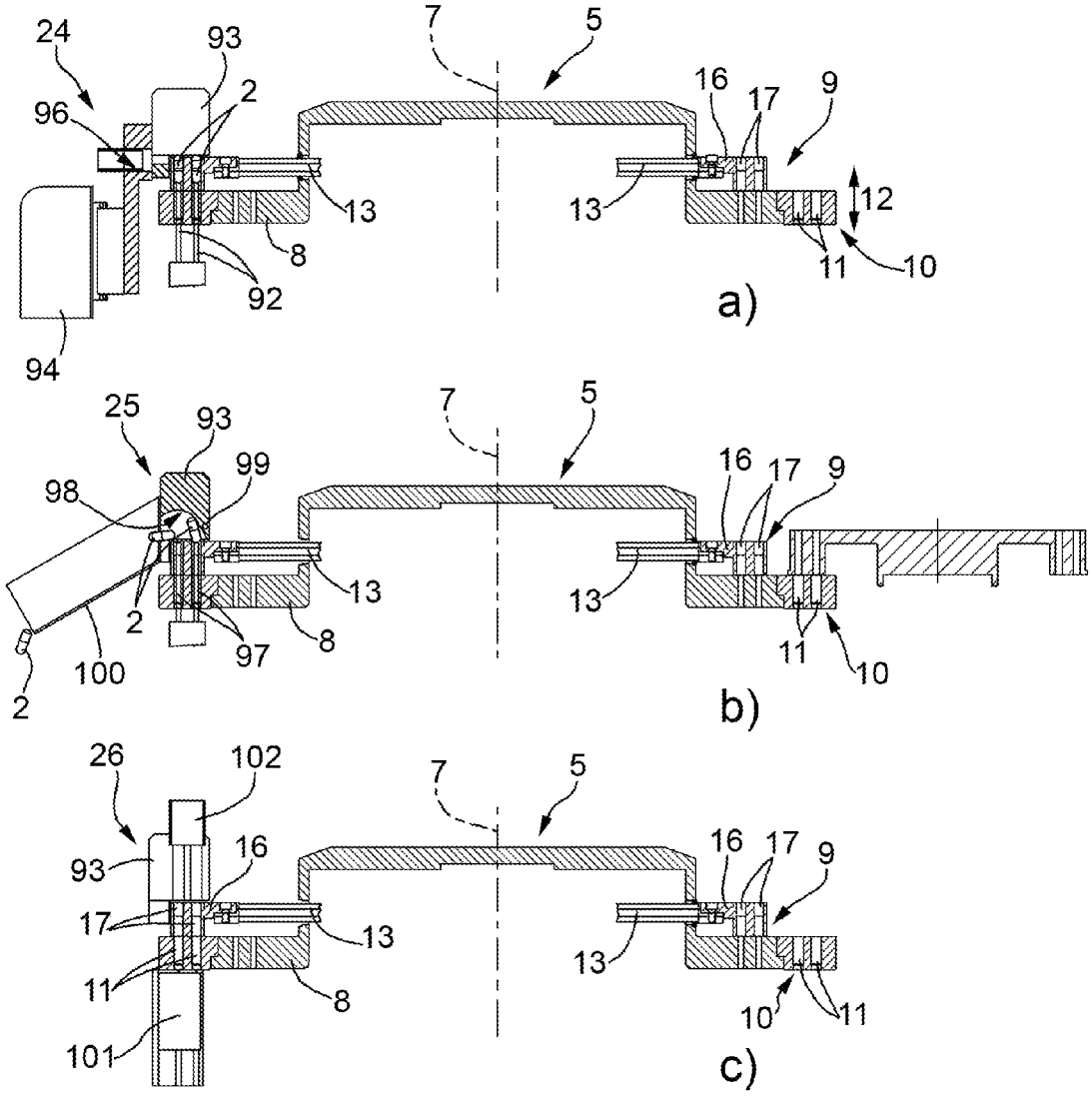
FIGS. 8*a* to 8*c* are three diagrammatic section views with parts removed for clarity of a fourth detail of the machine in FIG. 1.

As shown in FIGS. 1, 6, and 7, the dosing station 21 comprises a dosing wheel 70 comprising, in turn, a substantially cylindrical hopper 71, which is cup-shaped with concavity facing upwards, further has a longitudinal axis 72 parallel to direction 12, is limited at the bottom by a bottom wall 73 substantially perpendicular to the axis 72 itself, and is provided with a substantially vertical divider partition 74, which extends upwards from the wall 73 to divide the inside of the hopper 71 into two mutually adjacent portions 71*a*, 71*b*, of which only portion 71*a* contains the powdery pharmaceutical product while portion 71*b* extends over the disk 8.

The wall 73 is fixed to a free end of a sleeve 75, which extends through the frame 6 coaxial to the axis 72, and is rotationally coupled to the frame 6 to intermittently rotate with respect to the frame 6 and under the bias of an actuating device (not shown) interconnected and timed with the wheel 5, about the axis 72 itself.

The wall 73 is provided with a plurality of groups 76 of holes 77 (six groups 76 in the case in point), which are uniformly distributed about the axis 72, are advanced by the wall 73 about the axis 72, and each comprise a plurality of holes 77, which are equal in number to the number of seats 11 of a group 10 of seats 11, are obtained through the wall 73 in direction 12, and are distributed according to two rows parallel to one another and transversal to axis 72.

Each group 76 of holes 77 is associated to a lower closing device 78 comprising a supporting bar 79, which is substantially T-shaped, it extends inside the sleeve 75 in direction 12, it is fed by the sleeve 75 about the axis 72, and it is mobile, with respect to the hopper 71, in direction 12 under the bias of a cam actuating device 80 comprising a circular cam 81 fixed to the frame 6 coaxially to the axis 72 and a tappet roller 82 rotationally mounted on a lower end of the bar 79 and engaged in the cam 81 itself.

The bar 79 supports a plurality of lower closing elements 83 of elongated shape, which extend upwards from the bar 79 in direction 12, are equal in number to the number of holes 77 of a group 76 of holes 77, and are moved by the bar 79 in direction 12 between a raised closing position, in which the elements 83 extend within the relative holes 77, and a lowered opening position, in which the elements 83 are arranged underneath the wall 73 at a distance from the wall 73 approximating by excess the thickness of the disk 8.

When arranged in their raised closing positions, the elements 83 each limit at the bottom a respective dosing chamber of given volume and of height equal to the distance between the relative element 83 and the upper surface of the wall 73. With this regard, it is worth noting that the conformation of the cam 81 and/or the position of the cam 81 in direction 12 are selectively controlled to vary the raised closing position of the elements 83 and, thus, the height and the volume of the dosing chambers.

The wheel 70 further comprises an upper compacting device 84 comprising two vertical uprights 85, which extend through the frame 6 in direction 12, are uniformly distributed about axis 72, are arranged on opposite sides of the hopper 71, and are slidingly coupled to the frame 6 for performing with respect to the frame 6 itself, rectilinear movements in direction 12 under the bias of a cam actuating device 86 comprising a circular cam 87 mounted to continuously rotate about the axis 72 and, for each upright 85, a respective tappet roller 88 mounted to rotate on a lower end of the relative upright 85 and engaged by the cam 87 itself.

A circular, substantially flat plate 89 is fixed to the upper ends of the uprights 85, which plate 89 is substantially orthogonal to direction 12, and supports in the case in point four groups 90 of elongated shape upper compacting elements 91 distributed about the axis 72, and wherein three groups 90 are arranged over the portion 71*a* and a group 90 is arranged over the portion 71*b*.

Each group 90 comprises a plurality of elements 91, which are equal in number to the number of holes 77 of a group 76 of holes 77, are distributed according to two reciprocally parallel rows transversal to axis 72, and they extend downwards from plate 89 in direction 12.

In use, the elements 83 of each lower closing device 78 are moved and kept in the raised closing position of the relative holes 77 thereof at the portion 71*a* of the hopper 71, and they are moved to the lowered opening position thereof at the portion 71*b* of the hopper 71 to allow the disk 8 and, thus, a group 10 of seats 11 and the relative bottoms 3 to be inserted between the wall 73 and the elements 83 themselves.

At each stop of the dosing wheel 70, the elements 91 of each of the three groups 90 of elements 91 arranged above the portion 71*a* are lowered by the device 86 in direction 12 to compact the powdery pharmaceutical product contained inside the relative holes 77 underneath, and the elements 91 of the group 90 of elements 91 arranged above the portion 71*b* and the disk 8 are lowered by the device 86 in direction 12 to discharge the powdery pharmaceutical product contained in the holes 77 underneath into the relative bottoms 3 fed by the wheel 5 underneath the portion 71*b* itself.

The operation of the machine 1 will now be described with reference to FIG. 1, assuming the filling of the capsules 2 of one group of pockets 18 only, and starting from an instant in which the considered supporting arm 13 is arranged in station 19 in its advanced position to allow each of the pockets 18 taken into consideration to receive and open a relative capsule 2.

During the advancement of the considered pockets 18 from the station 19 to the station 20, the supporting arm 13 is moved from the retracted position thereof so as to free the top of the lower seats 11, and thus the relative bottoms 3, and to allow during a single stop of the pockets 18 in the station 20 itself both the possible dosing of a pharmaceutical product into the bottoms 3 and the raising of the pushing elements 69 of the expeller device 62, and thus the expelling of any capsules 2 closed in station 19 from the relative upper seats 17.

The arm 13 is kept in the retracted position thereof during the three subsequent stops in stations 21, 22, and 23 to allow the feeding devices (not shown) of the stations 21 and/or 23 and/or the dosing wheel 70 of the station 22 to feed the relative pharmaceutical products into the considered bottoms 3.

The arm 13 is thus moved again to the advanced position thereof during the advancement thereof from the station 23 to the station 24, at which the capsules 2 are closed by means of a plurality of lower pushing elements 92, which are equal in number to the number of seats 11 of a group 10 of seats 11, are mobile, with respect to the frame 6, in direction 12 between a lowered resting position and a raised working position, in which the pushing elements 91 extend within the relative seats 11 for raising the relative bottoms 3, and cooperate with an upper stopping plate 93 arranged so as to block the caps 4 in direction 12 and allow the closing of the capsules 2.

Figure 9:
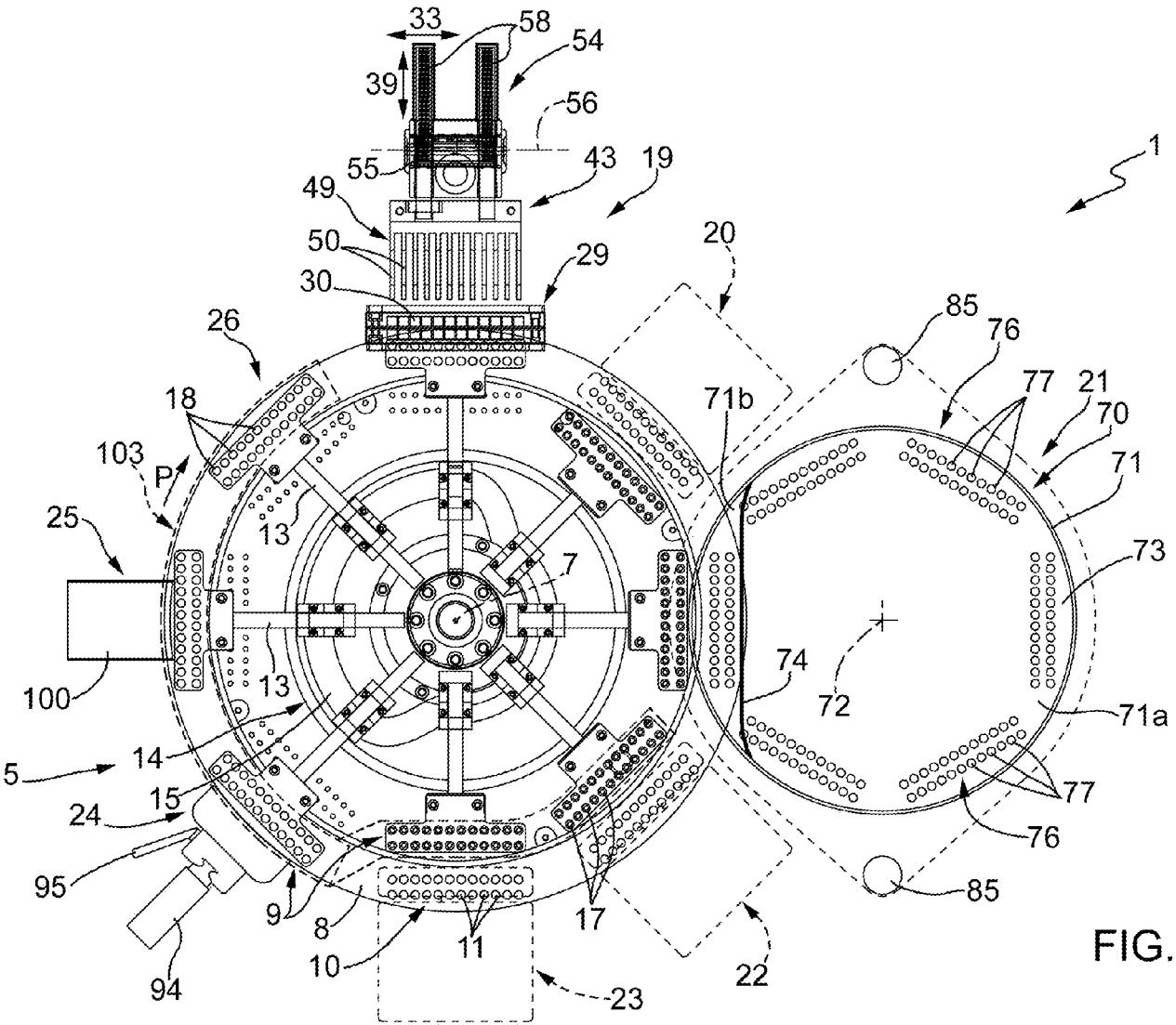
FIG. 9 is a diagrammatic plan view, with parts removed for clarity, of a variant of the machine in FIG. 1.
Figure 10:
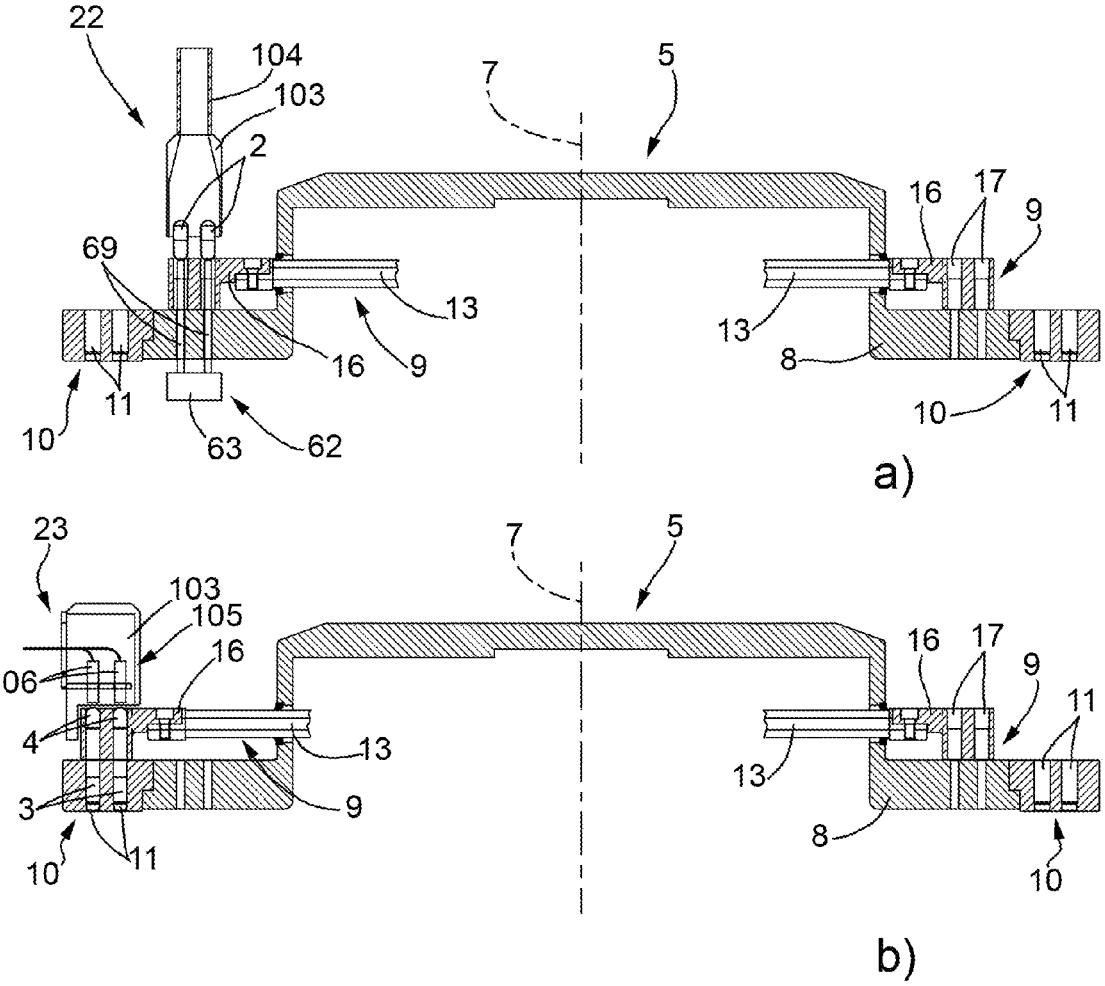
FIGS. 10*a* and 10*b* are two diagrammatic plan views, with parts removed for clarity, of a detail of the machine in FIG. 9.

The plate 93 is shaped as a circular sector, extends about the axis 7 and over the disk 8 at the stations 24, 25, and 26, is slidingly coupled to a vertical upright 94 of the frame 6 for performing with respect to the frame 6, rectilinear movements in direction 12, and is blocked along the upright 94 by means of a locking lever 95 (FIG. 9), which allows both to selectively control the position of the plate 93 in direction 12 according to the size of the capsules 2 and to remove the plate 93 from the frame 6 to facilitate maintenance and cleaning of the machine 1.

The plate 93 is further provided at station 24, with a sucking mouth 96 connected to a pneumatic suction device (known and not shown) to suck up the mixture of air and pharmaceutical powder exiting from the capsules 2 when they are closed.

After having lowered the pushing elements 92 the considered group of pockets 18 is fed in sequence through stations 25 and 26 with the arm 13 in its advanced position.

At station 25, the capsules 2 are unloaded from the conveying wheel 5 by means of a plurality of lower pushing elements 97, which are equal in number to the number of seats 11 of a group 10 of seats 11, are mobile with respect to the frame 6 in direction 12 between a lowered resting position and a raised working position, in which the pushing elements 97 extend within the relative pockets 18 to disengage the capsules 2 from the relative seats 17 and to push them against an upper diverting means 98, which is obtained in the plate 93, and cooperates with a compressed air pneumatic circuit 99 partially obtained through the plate 93 to divert the capsules 2 towards an outlet chute 100 coupled to the plate 93 itself.

At station 26, the pockets 18 are cleaned by combining the action of a jet of compressed air fed upwards through the pockets 18 by a compressed air pneumatic circuit 101 fixed to the frame 6 with the action of a sucking pneumatic circuit 102 obtained in part through the plate 93.

The variant shown in figures from 9 to 10 differs from that shown in the previous figures only in that herein:

the expeller device 62 is moved from station 20 to station 22; and the plate 93 is eliminated and replaced by a shaped plate 103, which is similar to the plate 93, is shaped as a circular sector, and extends about the axis 7, over the disk 8 at the stations 24, 25, and 26, and over the grip and transfer head 16 on a case-by-case basis in turn in stations 22 and 23.

The plate 103 is equivalent to the plate 93 at the stations 24, 25, and 26, is provided at station 22 with a sucking mouth 104 cooperating with the elements 69 of the device 62 for picking any capsules 2 remained closed in station 19 from the relative seats 17, and is provided at the station 23 with a control device 105 of the presence of the capsules 2 comprising a plurality of optical fibers 106, which are equal in number to the number of seats 17 of a head 16, extend through the plate 103, and are each facing a relative seat 16.

The machine 1 has some advantages mainly constituted by the fact that:

the height of the upper seats 17 allows to radially move the arms 14 also when capsules 2 remained closed in station 19 are accommodated within the seats 17;

the assembly of the arms 13 over the disk 8 allows to integrate in stations 20 or 22 both the expelling of any capsules 2 closed in station 19 and the dosing of a pharmaceutical product;

the shape of the feeding device 29 and of the orienting device 43 allows to feed all capsules 2 into the pockets 18 of a group of pockets 18 at station 19 only;

the movement of the lower closing elements 83 of the dosing wheel 70 in direction 12 allows to open the holes 77 avoiding any sliding of the pharmaceutical powder on the elements 83 themselves; and the presence of the plates 93 and 103 facilitates both the equipment of the machine 1 according to the size of the capsules 2 and maintenance and cleaning of the machine 1 itself.

It is further worth specifying that the lower closing device 78 may further be used also with a conveying wheel 5 in which the disk 8 is arranged above the arms 13, the lower seats 11 are instead obtained through the arms 13, and the upper seats 17 are obtained through the disk 8 itself.

According to a variant (not shown), the elements 83 are eliminated and the closing of the holes 77 is carried out by directly moving the bar 79 into contact with the wall 73.

The invention claimed is:

1. Intermittent rotating machine for filling capsules with pharmaceutical products, each capsule comprising a bottom and a cap for closing the bottom, the machine comprising a conveying wheel, which is mounted to intermittently rotate around a rotation axis parallel to a substantially vertical direction, and is provided with a plurality of pockets arranged around said axis, wherein each of them receives a respective capsule, and is moved forward by the conveying wheel along a given path; an opening station of the capsules; at least a dosing station of a pharmaceutical product in the capsules; a closing station of the capsules comprising first raising means for raising the bottoms against the relative caps in said direction and upper stopping means to lock the caps in the direction; an outlet station of the capsules from the conveying wheel comprising second raising means for disengaging the capsules from the relative pockets and upper diverting means for diverting the capsules outside the conveying wheel; and a cleaning station comprising blowing pneumatic means and sucking pneumatic means mutually cooperating for cleaning the pockets; and being characterized in that it further comprises a supporting block extending around said axis; said upper stopping means, upper diverting means and sucking pneumatic means being formed in said supporting block.

2. Machine according to claim 1, wherein the supporting block is removably mounted on a fixed frame of the machine.

3. Machine according to claim 2, wherein the supporting block is mobile in the direction with regard to the frame; a locking device being provided for selectively locking the supporting block in the direction according to the size of the capsules.

4. Machine according to claim 1, wherein the closing station comprises further sucking pneumatic means for sucking the mixture of air/pharmaceutical product coming out of the capsules during their closing; the further sucking pneumatic means being formed in, or supported by, said supporting block.

5. Machine according to claim 1, wherein the outlet station further comprises an outlet chute for the capsules from the conveying wheel; the outlet chute being formed in, or coupled to, said supporting block.

6. Machine according to claim 1, wherein the outlet station further comprises further blowing pneumatic means for advancing the capsules along said upper diverting means; said further blowing pneumatic means being formed in, or supported by, said supporting block.

7. (Machine according to claim 1, further comprising an expelling station for disengaging the capsules still closed in the opening station from the relative pockets; the expelling station comprising third raising means for raising the capsules in said direction and a sucking opening for drawing the capsules raised by said third raising means.

8. Machine according to claim 7, wherein the sucking opening is formed in, or supported by, said supporting block.

9. Machine according to claim 1, further comprising optical control means for controlling the presence of the capsules in the relative pockets; the optical control means being supported by said supporting block.

10. Machine according to claim 1, wherein the supporting block has a circular shape and extends above the conveying wheel.

11. Intermittent rotating machine for filling capsules with pharmaceutical products, each capsule comprising a bottom and a cap for closing the bottom, the machine comprising a conveying wheel, which is mounted to intermittently rotate around a rotation axis parallel to a substantially vertical direction, and is provided with a plurality of pockets arranged around said axis, wherein each of them receives a respective capsule, and is moved forward by the conveying wheel along a given path; an opening station of the capsules; at least a dosing station of a pharmaceutical product in the capsules; a closing station of the capsules comprising first raising means for raising the bottoms against the relative caps in said direction and upper stopping means to lock the caps in the direction; an outlet station of the capsules from the conveying wheel comprising second raising means for disengaging the capsules from the relative pockets and upper diverting means for diverting the capsules outside the conveying wheel; and a cleaning station comprising blowing pneumatic means and sucking pneumatic means mutually cooperating for cleaning the pockets; and being characterized in that it further comprises a supporting block extending around said axis and removably mounted on a fixed frame of the machine; said upper stopping means, upper diverting means and sucking pneumatic means being formed in, or supported by, said supporting block, wherein the supporting block is mobile in the direction with regard to the frame; and wherein a locking device is provided for selectively locking the supporting block in the direction according to the size of the capsules.

12. Machine according to claim 11, further comprising an expelling station for disengaging the capsules still closed in the opening station from the relative pockets; the expelling station comprising third raising means for raising the capsules in said direction and a sucking opening for drawing the capsules raised by said third raising means.

13. Machine according to claim 11, further comprising optical control means for controlling the presence of the capsules in the relative pockets; the optical control means being supported by said supporting block.

14. Machine according to claim 11, wherein the closing station comprises further sucking pneumatic means for sucking the mixture of air/pharmaceutical product coming out of the capsules during their closing; the further sucking pneumatic means being formed in, or supported by, said supporting block.

15. Machine according to claim 11, wherein the outlet station further comprises further blowing pneumatic means for advancing the capsules along said upper diverting means: said further blowing pneumatic means being formed in, or supported by, said supporting block.

* * * * *